US010354826B2

(12) United States Patent
Blum et al.

(10) Patent No.: US 10,354,826 B2
(45) Date of Patent: Jul. 16, 2019

(54) FUSE IN CHIP DESIGN

(71) Applicant: VISHAY BCcomponents BEYSCHLAG GmbH, Heide (DE)

(72) Inventors: Werner Blum, Heide (DE); Reiner Friedrich, Heide (DE); Wolfgang Werner, Heide (DE); Reimer Hinrichs, Heide (DE)

(73) Assignee: Vishay BCcomponents Beyschlag GmbH, Heide (DE)

( * ) Notice: Subject to any disclaimer, the term of this patent is extended or adjusted under 35 U.S.C. 154(b) by 0 days.

(21) Appl. No.: 15/180,586

(22) Filed: Jun. 13, 2016

(65) Prior Publication Data

US 2016/0372293 A1 Dec. 22, 2016

Related U.S. Application Data

(63) Continuation of application No. 11/571,787, filed as application No. PCT/EP2005/006894 on Jun. 27, 2005, now Pat. No. 9,368,308.

(30) Foreign Application Priority Data

Jul. 8, 2004 (DE) ..... 10 2004 033 251

(51) Int. Cl.
*H01H 85/046* (2006.01)
*H01H 69/02* (2006.01)
(Continued)

(52) U.S. Cl.
CPC ..... *H01H 85/046* (2013.01); *H01H 69/022* (2013.01); *H01H 85/006* (2013.01);
(Continued)

(58) Field of Classification Search
CPC .. H01H 69/022; H01H 85/006; H01H 85/046; H01H 2085/0414; H01H 85/0411; Y10T 29/49107
(Continued)

(56) References Cited

U.S. PATENT DOCUMENTS 3,368,919 A 2/1968 Casale et al.
3,887,893 A 6/1975 Brandt et al.
(Continued)

FOREIGN PATENT DOCUMENTS

DE 10164240 A1 9/2002
EP 0 453 217 A1 10/1991
(Continued)

*Primary Examiner* — Anatoly Vortman
(74) *Attorney, Agent, or Firm* — Volpe and Koenig, P.C.

(57) ABSTRACT

To produce a cost-effective fuse in chip design, which is applied to a carrier substrate made of a $Al_2O_3$ ceramic having a high thermal conductivity, and which is provided with a fusible metallic conductor and a cover layer, in which the melting point of the metallic conductor may be defined reliably, it is suggested that an intermediate layer having low thermal conductivity be positioned between the carrier substrate and the metallic conductor, the intermediate layer being formed by a low-melting-point inorganic glass paste applied in the screen-printing method or an organic intermediate layer applied in island printing. Furthermore, a method for manufacturing the fuse is specified.

20 Claims, 2 Drawing Sheets

(51) Int. Cl.
*H01H 85/041* (2006.01)
*H01H 85/00* (2006.01)

(52) U.S. Cl.
CPC . *H01H 85/0411* (2013.01); *H01H 2085/0414* (2013.01); *Y10T 29/49107* (2015.01)

(58) Field of Classification Search
USPC ..... 337/297; 29/623
See application file for complete search history.

(56) References Cited

U.S. PATENT DOCUMENTS 4,331,947 A 5/1982 Noerholm
4,373,019 A 2/1983 Watanabe et al.
4,446,355 A 5/1984 Sato et al.
4,626,818 A 12/1986 Hilgers
4,685,203 A 8/1987 Takada et al.
4,754,371 A 6/1988 Nitta et al.
4,783,642 A 11/1988 Takada et al.
4,873,506 A * 10/1989 Gurevich ..... H01H 85/046 29/623
5,018,004 A 5/1991 Okinaga et al.
5,070,393 A 12/1991 Nakagawa et al.
5,166,656 A 11/1992 Badihi et al.
5,296,833 A 3/1994 Breen et al.
5,363,082 A 11/1994 Gurevich
5,432,378 A * 7/1995 Whitney ..... H01H 85/046 257/529
5,453,726 A 9/1995 Montgomery
5,617,069 A 4/1997 Arikawa et al.
5,699,032 A 12/1997 Ulm, Jr. et al.
5,712,610 A 1/1998 Takeichi et al.
5,914,649 A 6/1999 Isono et al.
5,929,741 A 7/1999 Nishimura et al.
5,977,860 A 11/1999 Ulm, Jr. et al.
6,002,322 A * 12/1999 Krueger ..... H01H 69/022 29/623
6,034,589 A 3/2000 Montgomery et al.
6,040,754 A 3/2000 Kawanishi
6,078,245 A 6/2000 Fritz et al.
6,154,372 A 11/2000 Kalivas et al.
6,269,745 B1 8/2001 Cieplik et al.
6,344,633 B1 2/2002 Furuuchi
6,384,708 B1 5/2002 Jollenbeck et al.
6,452,475 B1 9/2002 Kawazu et al.
7,385,475 B2 * 6/2008 Bender ..... H01H 69/022 337/227
8,976,001 B2 * 3/2015 Chen ..... H01H 85/044 337/153
9,368,308 B2 6/2016 Blum et al.
2001/0044168 A1 11/2001 Furuuchi et al.
2002/0014945 A1 2/2002 Furuuchi et al.
2003/0127706 A1 7/2003 Tanimura
2003/0151133 A1 8/2003 Kinayman et al.
2004/0169578 A1 9/2004 Jollenbeck et al.
2004/0184211 A1 9/2004 Bender et al.
2005/0141164 A1 6/2005 Bender et al.
2005/0264394 A1 12/2005 Furuuchi
2006/0028314 A1 2/2006 Furuuchi
2006/0125594 A1 6/2006 Furuuchi
2007/0278213 A2 12/2007 McMillin et al.

FOREIGN PATENT DOCUMENTS

JP 09-063454 A 3/1997
JP 09-129115 A 5/1997
JP 09-153328 A 6/1997
JP 10-050198 A 2/1998
JP 2001-052593 A 2/2001

* cited by examiner

FUSE IN CHIP DESIGN

CROSS REFERENCE TO RELATED APPLICATION

This application is a continuation of U.S. patent application Ser. No. 11/571,787, filed Jan. 8, 2007, issuing as U.S. Pat. No. 9,368,308 on Jun. 14, 2016, which is a 371 national stage of PCT/EP2005/006894, filed Jun. 27, 2005, which claims priority to German Patent Application No. 102004033251.7, filed Jul. 8, 2004, the entire contents of all of which are hereby incorporated by reference as if fully set forth herein.

BACKGROUND

The present invention relates to a fuse in chip design, which is applied to a carrier substrate made of an $Al_2O_3$ ceramic, having a fusible metal conductor, which is applied and structured using thin-film technology and is provided with a cover layer, as well as a cost-effective method for manufacturing the chip fuse.

Chip fuses are implemented on a ceramic base material with the aid of methods known to those skilled in the art, such as photolithography. Other carrier materials, such as FR-4 epoxide or polyimide, are also known. Chip fuses are typically designed for a voltage up to 63 V.

In order to avoid damage to other electronic components due to a malfunction in the electrical power supply, which causes over voltage or too large a current flow, providing a fuse in the power supply is known. The fuse essentially comprises a carrier material and a metallic conductor made of copper, aluminium, or silver, for example. The maximum possible current strength which may flow through this conductor without fusing it is determined by the geometry and the cross-section of the conductor. If this value is exceeded, the electrical conductor is fused because of the heat resulting therein due to its electrical resistance and the power supply is thus interrupted before downstream electronic components are overloaded or damaged.

In the methods for manufacturing chip fuses in thick-film technology, in which the fusible element and contact layers are applied as pastes using screen-printing onto a substrate foundation having low thermal conductivity, sufficient precision of the geometry of the fusible element layers may only be implemented inadequately because of the screen-printing method. For high-value thick-layer fuses it is therefore necessary to process the fusible element and/or the fusible metallic conductor through additional laser cutting methods.

Typically, ceramic substrates having a high $Al_2O_3$ proportion, which have been glazed over the entire surface, or ceramic substrates, which are low in aluminium oxide, having a low thermal conductivity are selected as the substrate foundation. Both types of substrate are significantly more expensive than typical ceramic substrates made of 96% $Al_2O_3$ in thick-film quality, for example, which are used in manufacturing passive components.

In a method for manufacturing a fuse in thin-film technology, a fusible metallic conductor is applied through electrochemical methods or through sputtering. Especially high precision of the cut-off and/or fusing characteristic is achieved in this case through photolithographic structuring of sputtered layers, a substrate low in aluminium oxide having a low thermal conductivity being used as the foundation.

JP 2003/173728 A discloses a manufacturing method for a chip fuse in thin-film technology, a fuse 14 and a cover layer 15 being positioned on a substrate 11. The fuse 14 is structured using photolithography. The substrate 11 has a low thermal conductivity so that it does not dissipate the heat in the electrical conductor 14 caused by current flowing through the electrical conductor 14 and thus favours fusing of the electrical conductor 14. The electrical conductor 14 is in direct contact with the substrate 11.

JP 2002/140975 A describes a fuse having a metallic conductor 14 made of silver, which is also positioned directly on a substrate 11 having low thermal conductivity, the metallic conductor 14 being electroplated or implemented as a thick layer.

JP 2003/151425 A discloses a fuse having a glass ceramic substrate 11 having a low thermal conductivity and a metallic conductor 14 in thick-film technology.

JP 2002/279883 A also describes a fuse for a chip in which the fusible region 17 of the conductor 15 is manufactured through complex laser processing. This requires additional time-consuming and costly processing steps.

JP 2003/234057 A discloses a fuse resistor having a resistor 30 on a substrate 10, a further heat-storing layer 42 being provided between the resistor 30 and the substrate 10 in order to store the heat arising in the resistor 30. The fusible region is also manufactured through laser processing.

JP 08/102244 A describes a fuse 10 in thick-film technology having a glass glaze layer 2 having a low thermal conductivity, the glass layer 2 being positioned on a ceramic substrate 1 and a fuse 3 being applied to the glass layer 2.

JP 10/050198 A discloses a further fuse in thin-film technology having a complex layer construction, in which a further elastic silicone layer 6 is implemented on the conductor 3 and a glass layer 5.

DE 197 04 097 A1 describes an electrical fuse element having a fusible conductor in thick-film technology and a carrier, the carrier comprising a material having poor thermal conductivity, particularly a glass ceramic.

DE 695 12 519 T2 discloses a surface-mounted fuse device, a thin-film fusible conductor being positioned on a substrate and the substrate preferably being an FR-4 epoxide or a polyamide.

Therefore, a method is known for manufacturing chip fuses in thick-film technology using special ceramics or even $Al_2O_3$ ceramics and a thermally insulating intermediate layer, and chip fuses in thin-film technology using special ceramics or other special carrier materials are also known.

SUMMARY

It is therefore the object of the present invention to specify a fuse according to the species which may be manufactured cost-effectively and with sufficient precision, its fusing characteristic being able to be defined precisely. Furthermore, a method for manufacturing the fuse is to be specified.

The core idea of the present invention is to combine the advantages of a cost-effective manufacturing process for passive components with the advantages of thin-film technology and precise photolithographic structuring, which is implemented by using a thermally insulating intermediate layer on $Al_2O_3$ ceramic in combination with thin-film technology and photolithographic structuring.

DETAILED DESCRIPTION

Figure 1:
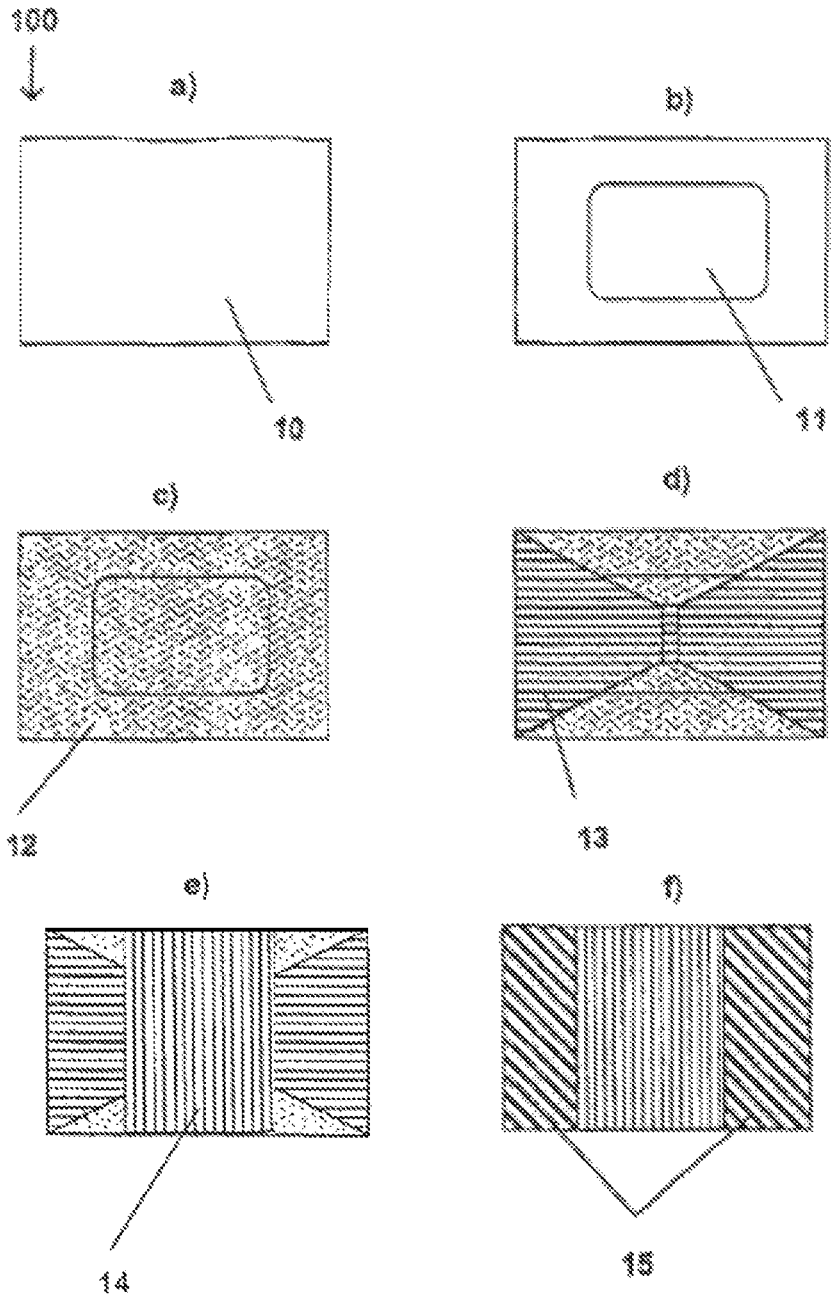
FIG. 1 shows the manufacturing process of a fuse in six steps.
Figure 2:
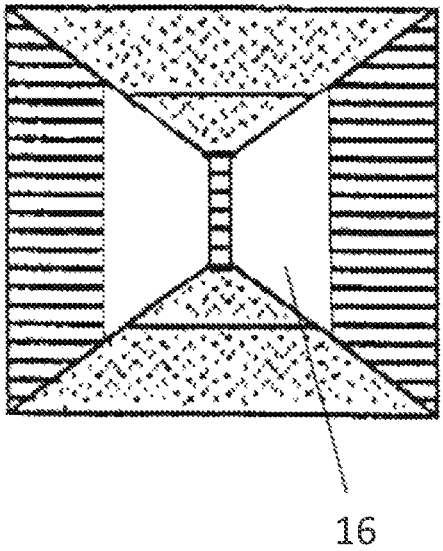
FIG. 2 shows an inorganic barrier layer covering a metallic conductor.

The core idea of the present invention thus comprises providing an intermediate layer, between a cost-effective ceramic substrate as a carrier having high thermal conductivity and the actual fusible metallic conductor, which is produced either through a cost-effective method, preferably low-melting-point inorganic glass pastes applied in the island printing method or an organic layer applied in island printing. Because of the low thermal conductivity of this intermediate layer, the heat arising in the metallic conductor due to the current flowing through it is not dissipated downward through the carrier substrate, which typically has a higher thermal conductivity, so that the conductor fuses in the desired way at a defined current strength therein. This intermediate layer is used as the thermal insulator. A low-melting-point inorganic glass paste is preferably used as the intermediate layer, which is particularly applied to the carrier substrate in the screen-printing method. This offers a significant advantage in relation to other substrates having low thermal conductivity, since the latter may be provided and/or manufactured practically only as special productions, while in contrast, through the application of glass islands as the thermally insulating intermediate layer, cost-effective standard ceramics may now be used, even those only having moderate surface composition (thick-film quality) being able to be used. In an alternative embodiment, the intermediate layer is an organic intermediate layer, which is particularly applied in island printing and subsequently baked and/or cured in the way known to those skilled in the art through the effect of heat in the carrier substrate. In this case, through island printing, which is simple to perform, arbitrary shaping of the intermediate layer may also be obtained, and $Al_2O_3$ ceramics may be used as the carrier material.

The advantage of the present invention is that a cost-effective standard ceramic, a thermally insulating intermediate layer, which may be manufactured cost-effectively in the screen-printing method, having the advantage of thin-film technology, and photolithographic structuring may be combined. In this way, high-precision and cost-effective fuses for safeguarding electronic assemblies from fault currents may be manufactured in miniaturized embodiments.

An aluminium oxide substrate is advantageously used as the carrier substrate for the fuse, which is available cost-effectively and in any arbitrary shape and size from practically all manufacturers of ceramic substrates of this type and is used, for example, in mass production of resistor manufacturers. Aluminium oxide ceramic substrates of this type may already be provided by the manufacturer with preliminary notches in the shape of the chips to be manufactured later from the substrate. In both of the embodiments described above, the intermediate layers are applied in the region of the preliminary notches predefined by the manufacturer, for example, in order to separate the carrier substrate in a known way without damaging the intermediate layers through fracturing processes during a later isolation process.

In order to improve the adhesion of the metallic conductor to the intermediate layer, an inorganic or an organic adhesion promoter may be applied directly to the intermediate layer in the spray method or through sputtering.

In an advantageous embodiment, the metallic conductor is formed by a low-resistance metal layer in order to be able to set the melting point of the fuse precisely.

In a first embodiment, this metal layer is applied to the intermediate layer and/or the adhesion promoter layer through sputtering. If the sputtered metal layer was applied to a carrier substrate glazed over its entire surface, this would lead to reduced adhesion, so that delamination of the metal layer in the pre-contact region could arise during an isolation process using fracturing. By applying the metal layer onto a thermally insulating island in the form of an intermediate layer having low thermal conductivity, good adhesion of the metal layer to the rougher aluminium oxide ceramic is ensured in the contact region, since smooth surfaces are produced by these glass islands in the region of the fuse, through which the photolithographic structuring of the fuse may be performed especially precisely, since in contrast to this, carrier substrates made of ceramics having poor thermal conductivity have higher surface roughness, which is unfavourable for precise photolithographic structuring.

For structuring the metallic conductor into the form of the desired fuse, it is suggested that this be performed through positive or negative lithography. In a positive lithography process, a metal layer, such as copper, is deposited over the entire area onto the layer positioned underneath and the desired structure is subsequently photo lithographically etched into the layer, for example. In a negative lithography process, first a photo resist is deposited, sprayed, for example, onto the layer lying underneath, i.e., the intermediate layer or the adhesion promoter layer, and subsequently photo lithographically structured in the desired way. Subsequently, a metal layer, such as a sputtered copper film, is deposited thereon and the remaining photo resist regions having the metal film thereon are removed.

To protect the fuse, one or more cover layers are applied to cover the metallic conductor or preferably the entire fuse, which may be formed by an inorganic barrier layer 16, among other things. The organic cover layer is particularly a polyamide, polyimide, or an epoxide, and may also be implemented as multilayered.

For the contacts of the fuse, the end contacts of the metallic conductor are produced through electrode position of a metallic barrier layer, typically made of nickel, and the final layer, which may be soldered or bonded, typically made of tin or tin alloys.

In the following, the present invention will be explained in greater detail on the basis of the drawing.

In the manufacturing process of a fuse 100 shown in FIG. 1, first a thermally insulating intermediate layer 11 is deposited in island form (step b) onto a carrier substrate (step a), preferably an aluminium oxide ceramic. An adhesive layer 12 for improving the adhesion of the metallic conductor 13 to the foundation is applied (step c) to this intermediate layer 11 and the surrounding carrier substrate 10. Subsequently, the metallic conductor 13, such as a copper layer which is sputtered on and photo lithographically structured in the desired way (step d), is applied to the adhesive layer 12.

In this way, through the thickness and width of the web in the central region of the metallic conductor 13, the maximum current strength is predefined, this web fusing if the maximum current strength is exceeded and other electronic components thus being protected from damage. Through the thermally insulating intermediate layer, the heat conduction into the carrier substrate 10 is strongly suppressed, so that the melting point of the fuse 100 may be defined precisely.

Subsequently, the fuse 100 and/or the central region of the metallic conductor 13 is/are coated with an organic cover layer 14, such as a polyamide or an epoxide, in order to protect the fuse 100 from damage. For the contacts, the end contacts 15 of the metallic conductor 13 are electroplated, using nickel and tin, for example.

LIST OF REFERENCE NUMBERS

100 fuse
10 carrier substrate
11 intermediate layer
12 adhesive layer
13 metallic conductor
14 cover layer
15 end contact

What is claimed is:

1. A fuse in chip design, comprising:

a substrate having a first surface facing in a first direction;

an intermediate layer disposed on the first surface of the substrate and leaving exposed portions of the first surface of the substrate;

an adhesive layer completely covering and in contact with the intermediate layer and the exposed portions of the first surface of the substrate;

a fusible metallic conductor covering and in contact with at least a portion of the adhesive layer;

a cover layer coated over at least a part of the fusible metallic conductor and over and in contact with at least a portion of the adhesive layer, the cover layer leaving exposed a first area having a first surface facing in the first direction comprising portions of the fusible metallic conductor and portions of the adhesive layer that remain uncovered on a first side of the cover layer, and a second area having a first surface facing in the first direction comprising portions of the fusible metallic conductor and portions of the adhesive layer that remain uncovered on a second side of the cover layer;

a first contact plated directly to the first surface of the first area; and a second contact plated directly to the first surface of the second area.

2. The fuse in chip design according to claim 1, wherein the substrate comprises an aluminum oxide ceramic.

3. The fuse in chip design according to claim 1, wherein the intermediate layer comprises at least one of an inorganic glass paste or an inorganic material.

4. The fuse in chip design according to claim 1, wherein the metallic conductor is formed by a low-resistance metal layer.

5. The fuse in chip design according to claim 1, wherein the metallic conductor comprises at least one of: Cu, Au, Ag, Sn, a Cu alloy, an Au alloy, an Ag alloy, or a Sn alloy.

6. The fuse in chip design according to claim 1, wherein the metallic conductor is structured using a positive or a negative lithography method.

7. The fuse in chip design according to claim 1, wherein the cover layer comprises at least one layer comprising at least one of: a polyamide, a polyimide, a polyamide imide, or an epoxide.

8. The fuse in chip design according to claim 1, further comprising an inorganic barrier layer between at least the cover layer and the metallic conductor.

9. The fuse in chip design according to claim 1, wherein the contacts comprise at least one of: copper, nickel, tin, or a tin alloy.

10. The fuse in chip design according to claim 1, wherein the intermediate layer has a thermal conductivity lower than that of the substrate.

11. A method for manufacturing a fuse in chip design, comprising the steps of:

forming an intermediate layer on a first surface of a substrate while leaving exposed portions of the first surface of the substrate, the first surface of the substrate facing in a first direction;

forming an adhesive layer in direct contact with and completely covering the intermediate layer and exposed portions of the first surface of the substrate;

forming a fusible metallic conductor on and in direct contact with at least a portion of the adhesive layer;

coating a cover layer over at least a part of the fusible metallic conductor and over and in contact with at least a portion of the adhesive layer, the cover layer leaving exposed a first area having a first surface facing in the first direction comprising portions of the fusible metallic conductor and portions of the adhesive layer that remain uncovered on a first side of the cover layer and a second area having a first surface facing in the first direction comprising portions of the fusible metallic conductor and portions of the adhesive layer that remain uncovered on a second side of the cover layer;

plating a first contact directly to the first surface of the first area; and plating a second contact directly to the first surface of the second area.

12. The method according to claim 11, wherein the substrate comprises an aluminum oxide ceramic.

13. The method according to claim 11, wherein the intermediate layer comprises at least one of an inorganic glass paste or an inorganic material.

14. The method according to claim 11, wherein the metallic conductor is formed by a low-resistance metal layer.

15. The method according to claim 11, wherein the metallic conductor comprises at least one of: Cu, Au, Ag, Sn, a Cu alloy, an Au alloy, an Ag alloy, or a Sn alloy.

16. The method according to claim 11, wherein the metallic conductor is formed using positive or a negative lithography.

17. The method according to claim 11, wherein the cover layer comprises at least one layer comprising at least one of: a polyamide, a polyimide, a polyamide imide, or an epoxide.

18. The method according to claim 11, further comprising an inorganic barrier layer between at least the cover layer and the metallic conductor.

19. The method according to claim 11, wherein the contacts comprise at least one of: copper, nickel, tin, or a tin alloy.

20. The method according to claim 11, wherein the intermediate layer has a thermal conductivity lower than that of the substrate.

* * * * *